US006516768B1

(12) United States Patent
Watanabe

(10) Patent No.: US 6,516,768 B1
(45) Date of Patent: Feb. 11, 2003

(54) FOUR-CYCLE ENGINE

(75) Inventor: Hitoshi Watanabe, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/664,514

(22) Filed: Sep. 18, 2000

(30) Foreign Application Priority Data

Sep. 17, 1999 (JP) ..... 11-264692

(51) Int. Cl.[7] ..... F02M 35/10
(52) U.S. Cl. ..... 123/184.36; 123/573
(58) Field of Search ..... 123/184.35, 184.36, 123/572, 573; 440/88

(56) References Cited

U.S. PATENT DOCUMENTS 4,838,215 A * 6/1989 Yasuda et al. ..... 123/184.36
5,476,402 A 12/1995 Nakai et al.
5,514,015 A 5/1996 Okazawa et al.
5,778,847 A 7/1998 Takahashi et al.
5,915,363 A 6/1999 Iwata et al.
5,941,205 A 8/1999 Hiraoka et al.
6,062,927 A 5/2000 Hiraoka et al.

* cited by examiner

*Primary Examiner*—Noah P. Kamen
(74) *Attorney, Agent, or Firm*—Knobbe, Martens, Olson & Bear, LLP.

(57) ABSTRACT

A four-cycle engine includes an improved construction that is provided with an air induction system, which is suitable for low speed engine operations and which can provide an easy assembling and/or maintenance work. The engine has multiple cylinders arranged in a V-configuration. An air induction system supplies air to combustion chambers of the cylinders and includes a pair of plenum chamber members. The plenum chamber members are generally disposed on an opposite side of a crankcase relative to a crankshaft. Both the plenum chamber members are positioned in close vicinity to each other. Each one of the plenum chamber members defines a plenum. A balance pipe is affixed to both the plenum chamber members to couple together the plenum chambers.

30 Claims, 13 Drawing Sheets

FOUR-CYCLE ENGINE

This invention is based on and claims priority to Japanese Patent Application No. Hei 11-264692, filed Sep. 17, 1999, the entire contents of which is hereby expressly incorporated by reference.

BACKGROUND OF THE INVENTION

1. Field of the Invention

This invention relates to a four-cycle engine, and more particularly to a four-cycle engine configured as a V-shape that has a suitable configured for an outboard motor.

2. Description of Related Art

Some outboard motors have recently employed a four-cycle engine in order to address environmental concerns. If an outboard motor is required to have a high power output, a multi-cylinder, V-shape engine is a typical selection for this purpose. For example, a V6, four-cycle engine is one engine type that can meet both of the foregoing demands, i.e., low emissions and high performance.

Because of its V shape, this type of engine typically includes an air induction system having a pair of air intake passages that supply air to combustion chambers in both of the cylinder banks. The air induction system also usually has a single or a pair of plenum chambers from which the air intake passages extend. The plenum chamber functions as an air silencer and/or an air coordinator for smoothing air flow to the respective combustion chambers.

In addition to high-speed performance, a typical outboard motor engine is required to operate at a trolling speed so that an associated watercraft can go forward very slowly. The trolling speed is obtained when the engine operates nearly at an idle speed. Generally, the longer the intake passages are, the better the engine will run at low engine speeds, i.e., at idle and trolling speeds. A single plenum chamber also is preferred over than multiple plenum chambers in order to lengthen the induction path to the engine cylinders.

A disadvantage arises, however, if the engine employs just one plenum chamber. A single plenum chamber must have openings on both its port and starboard sides that communicate with respective air intake passages. These air intake passages lead to the combustion chambers in the port and starboard cylinder banks, respectively. Normally, the plenum chamber and the intake passages are formed with members made of plastic or metal castings. Because of this, accurate positioning of an opening and a respective passage, which are mated together, can be difficult. This task is exacerbated by the fact that this step must be done with multiple passage and opening pairings and on both sides of the plenum chamber. Alignment on one side may throw-off alignment on the other side. This difficulty exists not only when the engine is assembled at a factory but also when the plenum chamber or the intake passages are replaced or removed during engine repair or maintenance.

A need therefore exists for an improved four-cycle engine having cylinders arranged in a V-shape configuration that is provided with an air induction system that is suitable for a low speed operation and that can be easily assembled and disassembled.

SUMMARY OF THE INVENTION

In accordance with one aspect of the present invention, a four-cycle, internal combustion engine comprises a cylinder body defining a plurality of cylinder bores. The cylinder bores extend generally horizontally and are spaced apart horizontally from each other to form a V-configuration. Pistons reciprocate within the respective cylinder bores. A pair of cylinder head members closes one ends of the cylinder bores to define combustion chambers with the cylinder bores and the pistons. A crankshaft is coupled with the pistons for rotation with the reciprocal movement of the pistons. A crankcase member closes another end of the cylinder bores to define a crankcase chamber in which the crankshaft extends generally vertically. An air induction system is arranged to introduce air into the combustion chambers. The air induction system includes a pair of plenum chamber members generally disposed on a side of the crankcase member opposite of the crankshaft. Both the plenum chamber members are positioned in close vicinity to each other. Each one of the plenum chamber members defines a plenum chamber to intake air into the air induction system. A balance pipe is affixed to both the plenum chamber members to couple together the plenum chambers.

Further aspects, features and advantages of this invention will become apparent from the detailed description of the preferred embodiment that follows.

BRIEF DESCRIPTION OF THE DRAWINGS

These and other features of this invention will now be described with reference to the drawings of a preferred embodiment, which is intended to illustrate and not to limit the invention. The drawings contain the following figures.

DETAILED DESCRIPTION OF THE PREFERRED EMBODIMENT OF THE INVENTION

Figure 1:
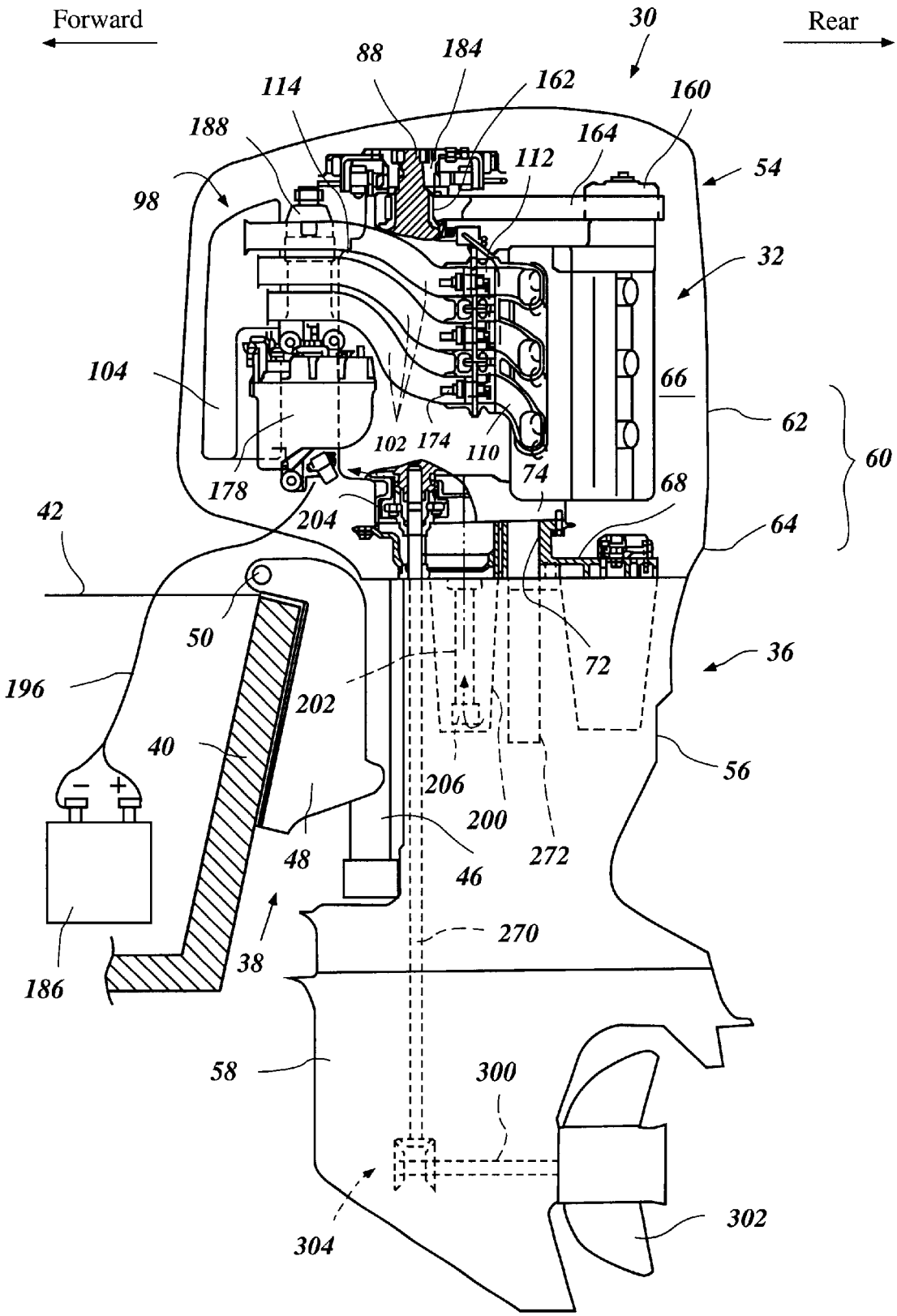
FIG. 1 is a schematic side elevational view of an outboard motor employing an engine configured in accordance with a preferred embodiment of the present invention. An associated watercraft is partially shown in section, as is a portion of the engine.

With primary reference to FIG. 1, an outboard motor 30 employs an internal combustion engine 32 configured in accordance with a preferred embodiment of the present invention. Although the present invention is shown in the context of an engine for an outboard motor, various aspects and features of the present invention also can be applied to engines for other types of marine outboard drive units (e.g., a stem drive unit or inboard motor of a personal watercraft) and also to other engines (e.g., land vehicle engines and stationary engines).

In the illustrated embodiment, the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 floating on the surface of a body of water. The bracket assembly 38 comprises a swivel bracket 46, a clamping bracket 48, a steering shaft and a pivot pin 50.

The steering shaft extends through the swivel bracket 46 and is affixed to the drive unit 36 by an upper mount assembly and a lower mount assembly. The steering shaft is pivotally journaled for steering movement about a generally vertically extending steering axis within the swivel bracket 46. A steering handle extends upwardly and forwardly from the steering shaft to steer the drive unit 36. The clamping bracket 48 includes a pair of bracket arms spaced apart from each other and affixed to the transom 40 of the associated watercraft 42. The pivot pin 50 completes a hinge coupling between the swivel bracket 46 and the clamping bracket 48. The pivot pin 50 extends through the bracket arms so that the clamping bracket 48 supports the swivel bracket 46 for pivotal movement about a generally horizontally extending tilt axis of the pivot pin 50. Although not shown, a hydraulic tilt and trim adjustment system is provided between the swivel bracket 46 and the clamping bracket 48 to tilt up and down and also for the trim adjustment of the drive unit 36.

As used through this description, the terms "fore," "front," forward" and "forwardly" mean at or to the side where the clamping bracket 48 is located, and the terms "aft," "rear," "reverse" and "rearwardly" mean at or to the opposite side of the front side, unless indicated otherwise or otherwise readily apparent from the context of use.

The drive unit 36 includes a power head 54, a driveshaft housing 56 and a lower unit 58. The power head 54 is disposed atop the drive unit 36 and includes the engine 32 and a protective cowling assembly 60. The protective cowling assembly 60 includes a top cowling member 62 and a bottom cowling member 64.

The protective cowling assembly 60 generally completely surrounds the engine 32 so as to enclose it in a closed cavity 66. The top cowling member 62 is detachably affixed to the bottom cowling member 64 with a conventional coupling mechanism so that the operator can access the engine 32 for maintenance or for other purposes.

As is well known, the top cowling member 62 has an air intake port disposed on its rear, top portion. A pair of air intake ducts is provided at a position adjacent to the intake port so that ambient air enters the closed cavity 66 through the port and the intake ducts. The top cowling member 62 is narrowed upwardly in section of a horizontal plane.

The bottom cowling member 64 has an opening at its bottom portion through which an upper portion of an exhaust guide member 68 extends. The exhaust guide member 68 is affixed atop the driveshaft housing 56. The bottom cowling member 64 and the exhaust guide member 68, thus, generally form a tray. The engine 32 is placed onto this tray and is affixed to the exhaust guide member 68 so as to be supported thereby. A gasket 70 (FIG. 11) is interposed between the engine 32 and the exhaust guide member 68. The exhaust guide member 68 also has an exhaust passage 72 through which burnt charges (e.g., exhaust gases) from the engine 32 are discharged as described below.

Figure 3:
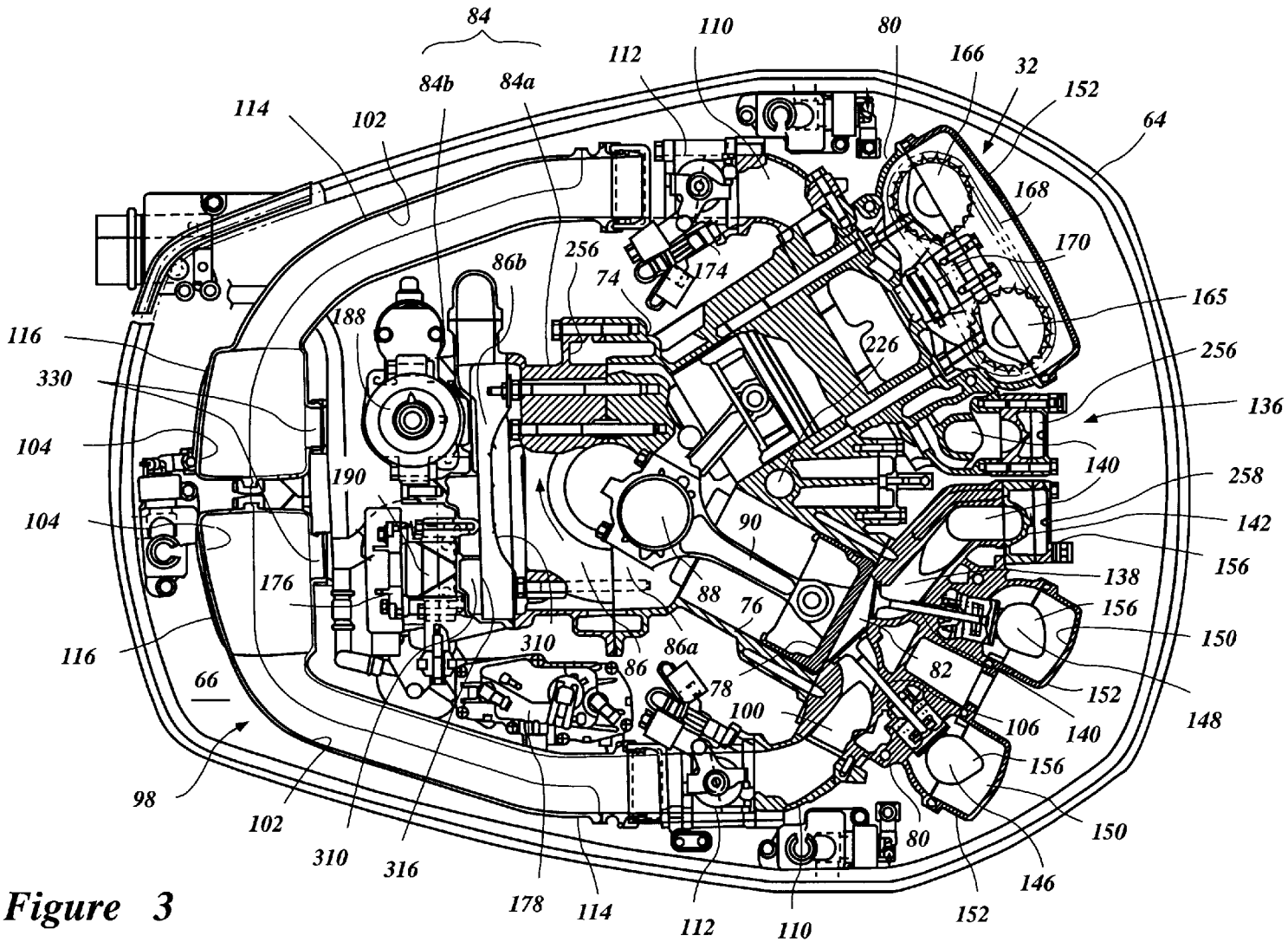
FIG. 3 is a top plan view of the power head showing in a manner similar to that illustrated in FIG. 2 except that the engine and its air induction system are illustrated in section.
Figure 4:
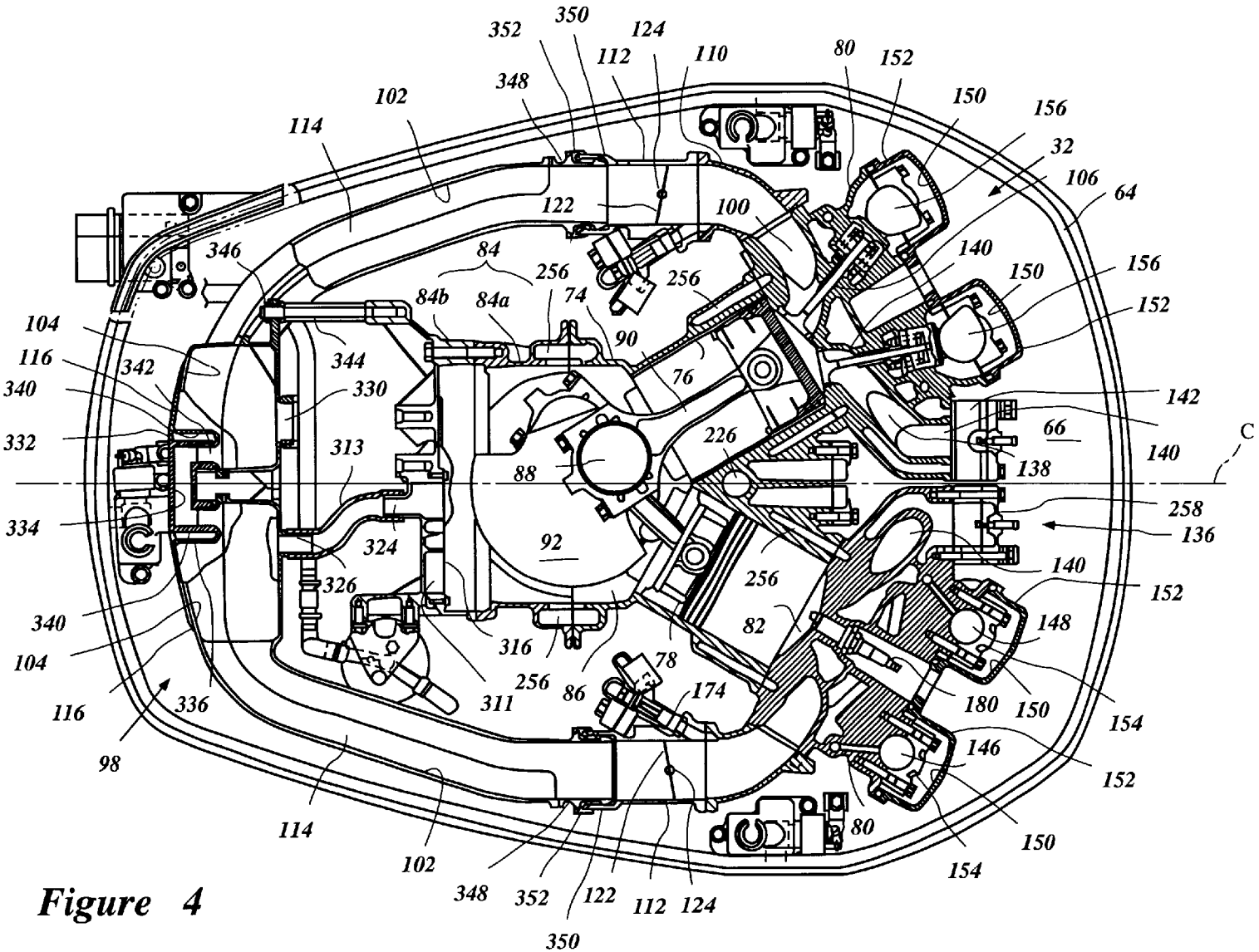
FIG. 4 is a top plan view of the power head shown in a manner similar to that illustrated in FIG. 3 except that an oil filter and some electrical components of the engine (e.g., an Electronic Control Unit) are omitted in order to reveal a breather tube.

The engine 32 in the illustrated embodiment operates on a four-stroke cycle combustion principle and powers a propulsion device. The engine 32 has a cylinder body 74. The cylinder body 74 defines six cylinder bores 76. The cylinder body 74 is generally configured as a V-shape to form two banks so that adjacent cylinder bores 76 are spaced apart horizontally from each other in a plan view as seen in FIGS. 3 and 4, although they are slightly off-set vertically, as known in the art. In the illustrated embodiment, each bank of the cylinder body 74 includes three cylinder bores 76 that extend generally horizontally and are spaced apart vertically from each other. That is, the engine 32 is a horizontal cylinder, V6 type. The number of cylinders, however, is merely exemplifying and engines having other number of cylinders are applicable.

Figure 2:
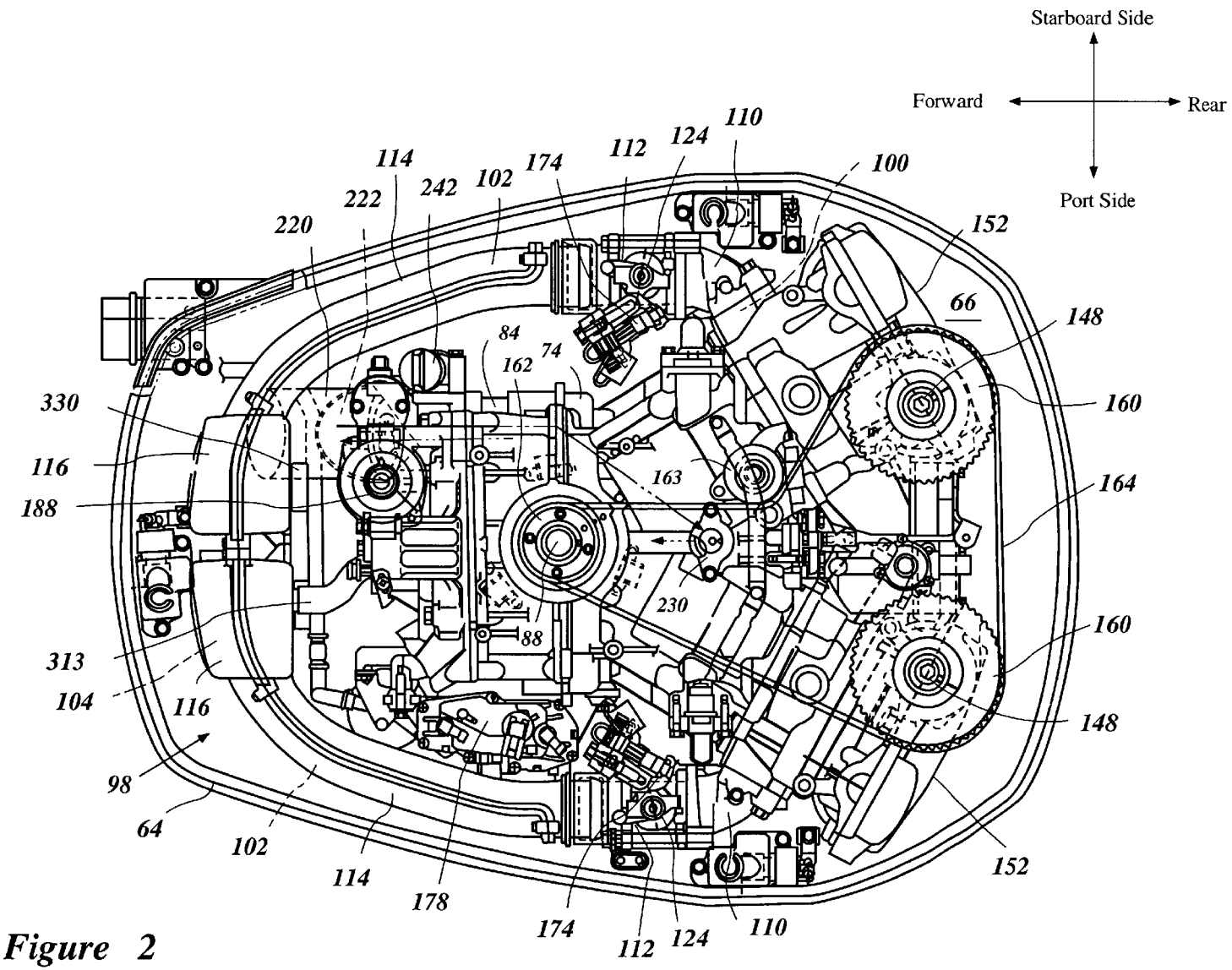
FIG. 2 is a top plan view of a power head of the outboard motor. A top cowling member of the power head is detached to show the engine.

As seen in FIGS. 2 and 3, a piston 78 reciprocates in each cylinder bore 76. A pair of cylinder head members 80 are affixed to one ends of the cylinder body 74 for closing the cylinder bores 76 of the respective banks. The cylinder head members 80 define six combustion chambers 82 with the pistons 78 and the cylinder bores 76. Each bank has three combustion chambers 82 in the illustrated embodiment.

Figure 11:
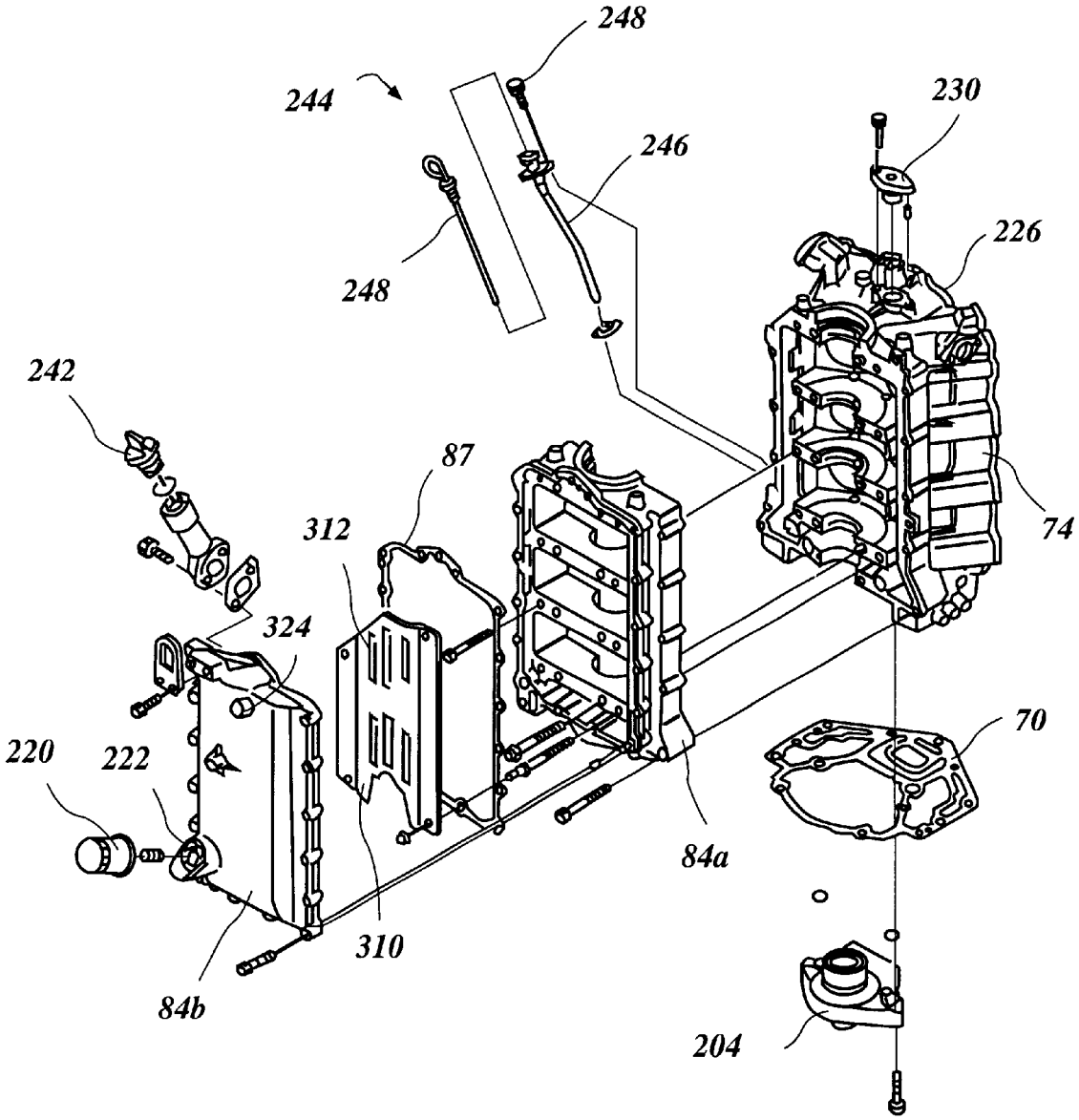
FIG. 11 is an exploded view of the engine including the cylinder body, the crankcase member, the crankcase cover, a baffle plate and the oil pump unit.

A crankcase assembly 84 closes the other ends of the cylinder bores 76 and defines a crankcase chamber 86 with the cylinder body 74. In the illustrated embodiment, the crankcase assembly 84 comprises two pieces, i.e., a crankcase member or inner member section 84*a* and a crankcase cover or outer member section 84*b*. The crankcase cover 84*b* is affixed to the crankcase member 84*a* via a gasket 87 (FIG. 11). The crankcase assembly 84, however, can be defined by a single piece.

Figure 5:
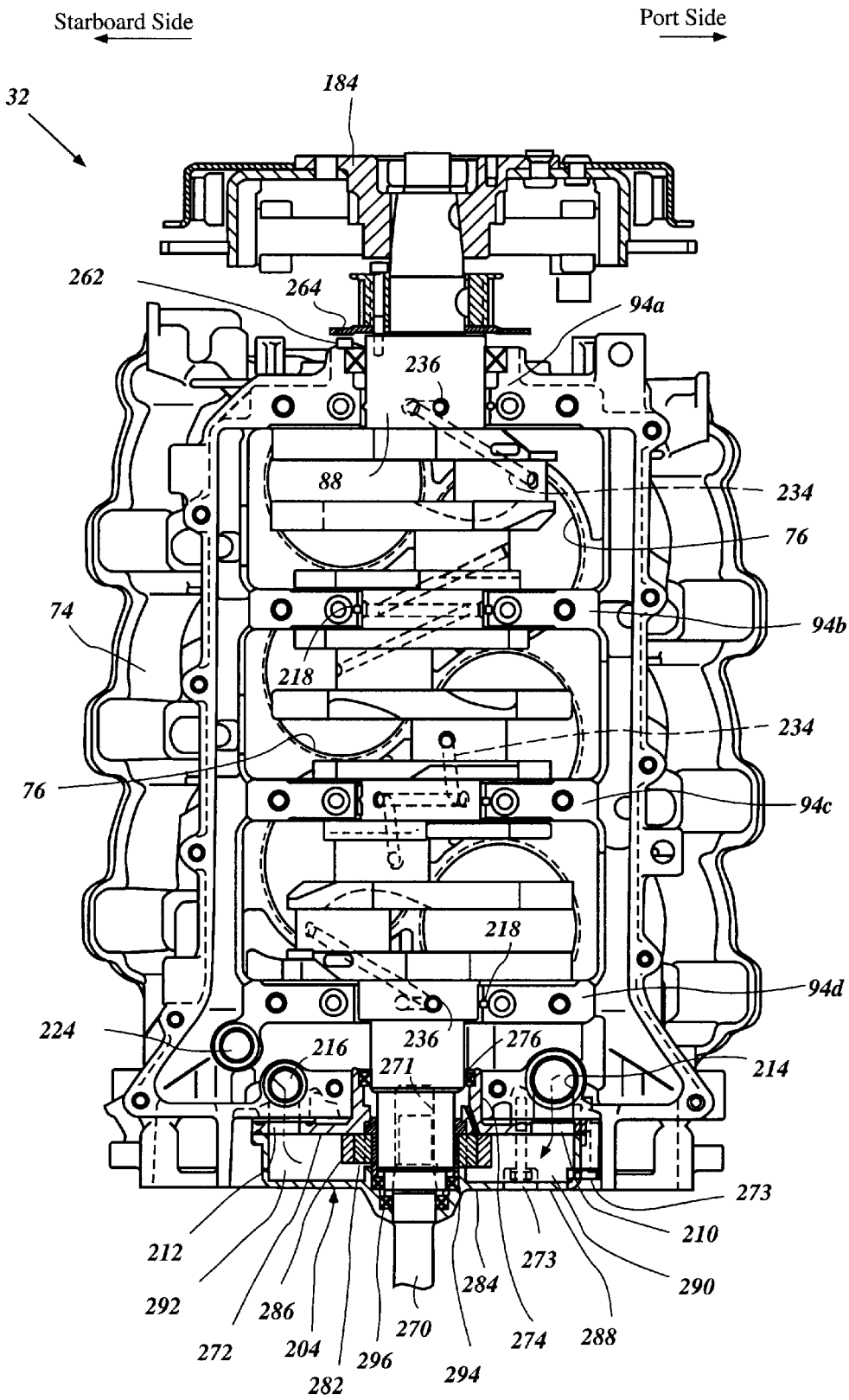
FIG. 5 is a front view of the engine with a crankcase member is removed. Some portions of the engine, including an oil pump unit, are shown in section.

A crankshaft 88 extends generally vertically through the crankcase chamber 86. The crankshaft 88 is rotatably coupled with the respective pistons 78 by connecting rods 90 and thus rotates with the reciprocal movement of the pistons 78. The crankshaft 88 has counter weights 92 disposed opposite of the throws to which the pistons 78 are coupled so as to effectively balance the rotation of the crankshaft. The crankshaft 88 is journaled by bearing blocks, which are defined by end portions of the cylinder body 74 and the crankcase member 84*a*. As best seen in FIG. 5, the bearing blocks comprise a top bearing portion 94*a*, intermediate bearing portions 94*b*, 94*c* and a bottom bearing portion 94*d*. Additional details of the crankcase assembly 84 and the crankcase chamber 86 will be described below.

The crankcase assembly 84 is located at the most forward position, then the cylinder body 74 and the cylinder head member 80 are disposed rearward from the crankcase assembly 84 one after another. At least, these major engine components 74, 80, 84 preferably are made of aluminum alloy.

The engine 32 includes an air induction system 98. The air induction system 98 supplies air from the closed cavity 66 of the cowling assembly 60 to the combustion chambers 82.

As seen in FIGS. 2 to 4, the air induction system 98 includes intake ports 100, a pair of intake passages 102 and a pair of plenum chambers 104.

Twelve intake ports 100 are provided, six of which are disposed on the cylinder bank on the starboard side and another six of which are disposed on the other cylinder bank on the port side. That is, each cylinder bore 76 has two intake ports 100. The intake ports 100 are defined in the respective cylinder head members 80 on the outer sides of the respective cylinder banks. The intake ports 100 are opened and closed by intake valves 106.

Three intake passages 102 extend from the respective intake port pairs 100 of one of the bank generally along a side surface of the cylinder body 74 and the crankcase assembly 84 on the starboard side, while another three intake passages 102 extend from the intake port pairs 100 of the other bank along the other side surface of the cylinder body 74 and the crankcase assembly 84 on the port side. When each intake port 100 is opened, the corresponding intake passage 102 communicates with the associated combustion chamber 82.

Figure 7:
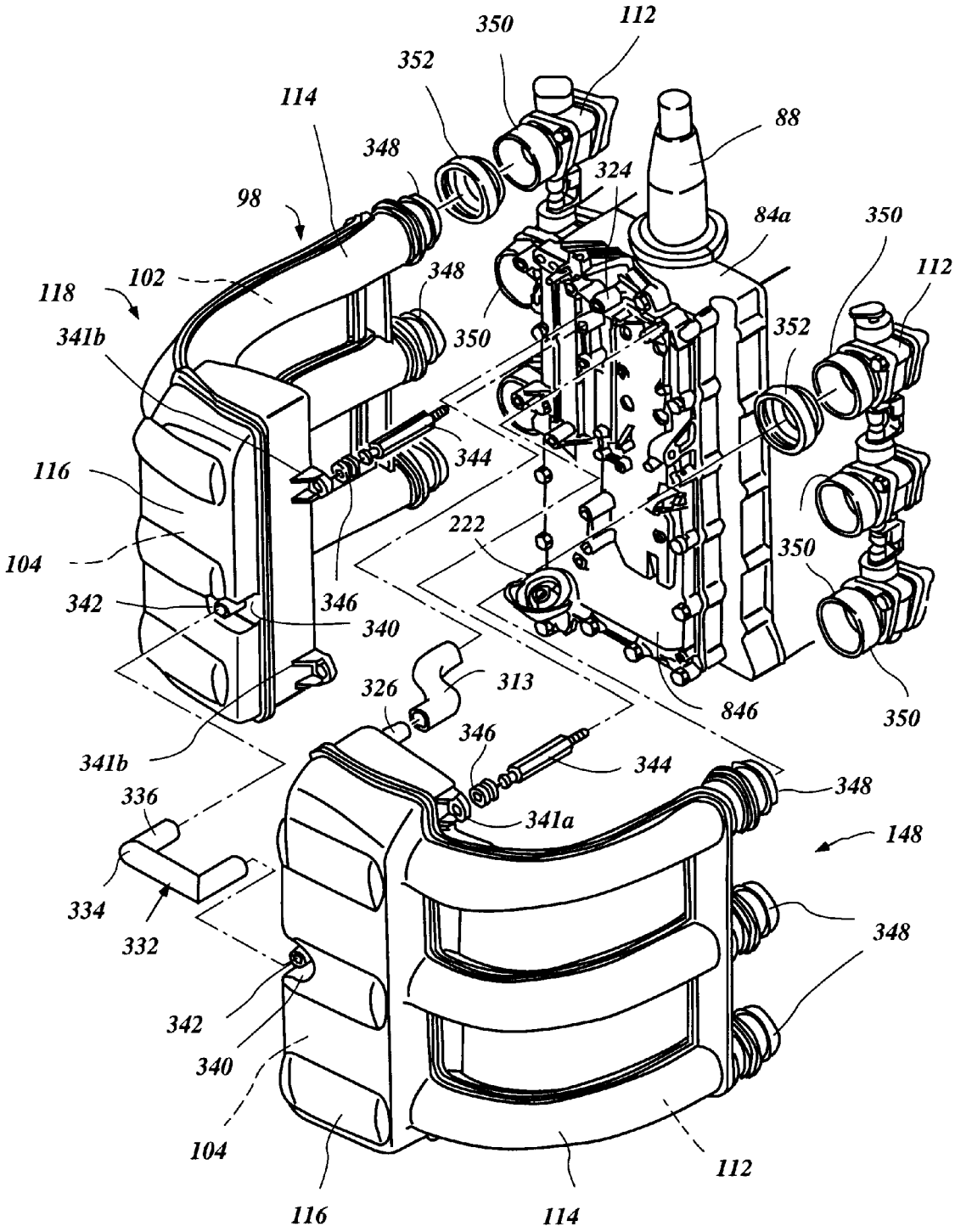
FIG. 7 is an exploded view of the engine including the crankcase member, the crankcase cover, the crankshaft and a major portion of the air induction system. Electrical components are omitted.

The air intake passages 102 are actually defined by intake manifolds 110, throttle bodies 112 and intake runners 114, while plenum chamber members 116 define the plenum chambers 104. Each intake manifold 110 is affixed to the cylinder head member 80. As best seen in FIG. 7, in the illustrated embodiment, the intake runners 114 on each bank are unified with one of the plenum chamber members 116 that is positioned to form a pair of intake units 118. The throttle bodies 112 are interposed between the intake manifolds 110 and the intake runners 114. The respective plenum chambers 104 are thus coupled to the associated intake ports 100 through the intake passages 102 defined by the intake runners 114, the throttle bodies 112 and the intake manifolds 110.

The intake manifolds 110 and the throttle bodies 112 preferably are made of aluminum alloy. The intake units 118 each including the intake runners 114 and the plenum chamber member 116 preferably are made of plastic material or aluminum alloy. The intake units 118 are produced by, for example, a conventional cast method. Of course, these engine components can be made of other materials and by other convention manufacturing processes.

In the illustrated embodiment, the respective throttle bodies 112 support throttle valves 122 disposed therein for pivotal movement about axes of valve shafts 124 which extend generally vertically. The valve shafts 124 are linked together to form a single valve shaft that passes through the entire throttle bodies 124. The throttle valves 130 are operable by the operator through a suitable linkage mechanism and a throttle cable.

Figure 9:
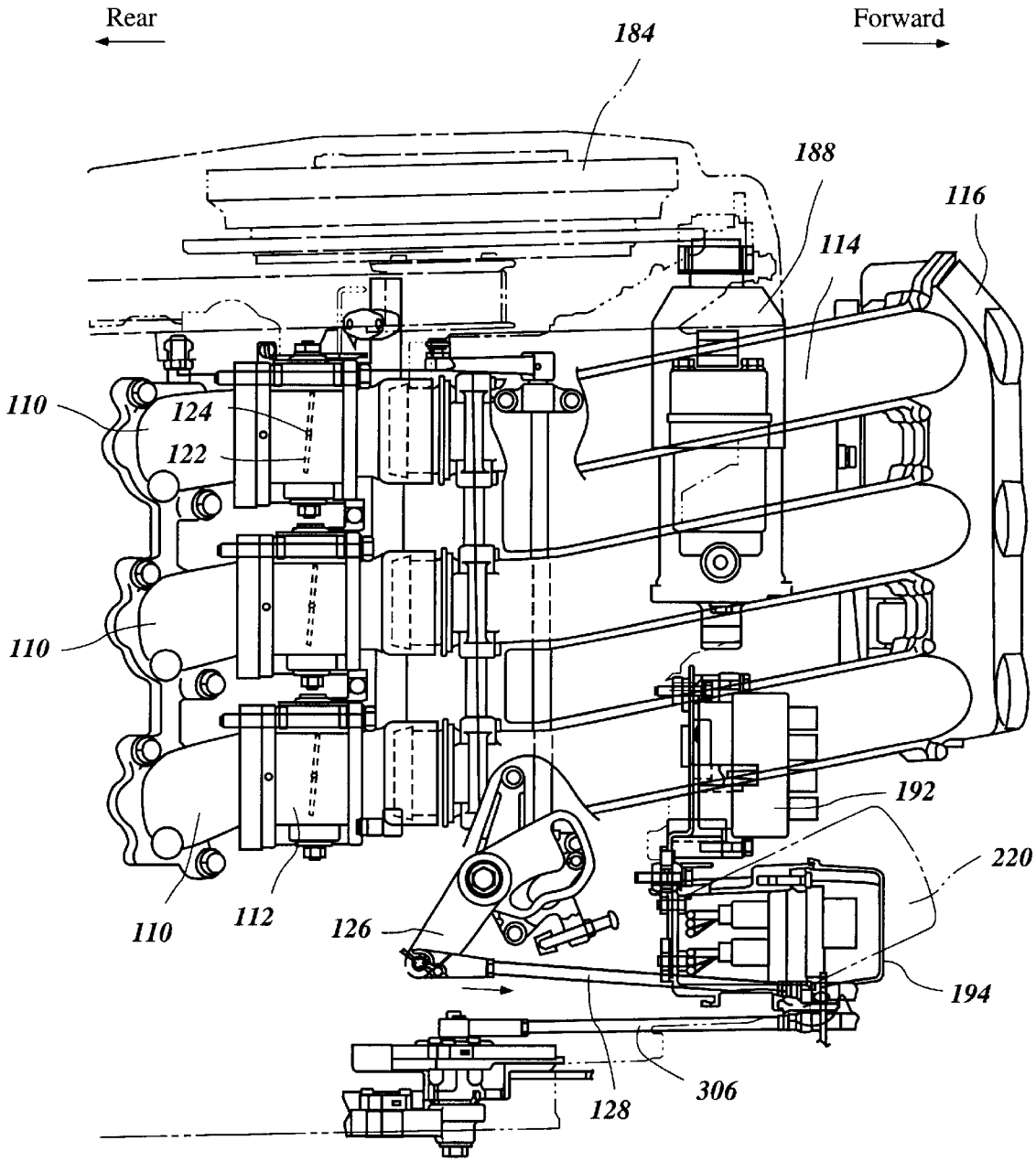
FIG. 9 is a schematic side view of the engine, specifically, the starboard side. A variation of a throttle valve arrangement is also shown.

The throttle bodies 112 may have another arrangement of throttle valves 122 that is shown in FIG. 9. The throttle valves 122 in this variation are disposed for pivotal movement about axes of valve shafts 124 which extend generally horizontally. Like the arrangement described above, the valve shafts 124 are linked together and are operable by the operator through a linkage mechanism 126 and a throttle cable 128.

When the operator operates the throttle cable 128, the linkage mechanism 126 activates the valve shafts 124 to open the throttle valves 122 for adjusting an amount of air passing there through. Conversely, when the throttle cable 128 is released, the linkage mechanism 126 moves the valve shafts 124 to close the throttle valves 122.

The engine 32 includes an exhaust system 136 that discharges the burnt charge (e.g., exhaust gases) outside of the outboard motor 30. Twelve exhaust ports 138 are provided, six of which are disposed in the cylinder bank on the starboard side, and another six of which are disposed in the other cylinder bank on the port side. That is, each cylinder bore 76 has two exhaust ports 138. The exhaust ports 138 are defined in the respective cylinder head members 80 on the opposite sides of the respective banks relative to the intake ports 100, i.e., inner sides of the banks. The exhaust ports 138 are opened and closed by exhaust valves 140. The respective banks have exhaust passages 140 extending generally vertically and parallel to each other in a space defined between both banks. The exhaust passages 140 are defined by and between the cylinder body 74 and exhaust members 142. When the exhaust ports 138 are opened, the combustion chambers 82 communicate with the exhaust passages 140. The exhaust passages 140 in turn communicate with the exhaust passage 72 of the exhaust guide member 68.

Each cylinder bank has an intake camshaft 146 and an exhaust camshaft 148, and both shafts extend generally vertically and parallel to each other. Because of the foregoing positions of the intake and exhaust ports 100, 138, both the exhaust camshafts 148 are positioned next to each other, and the respective intake camshafts 146 are spaced apart from each other so as to interpose both the exhaust camshafts 148 between the intake camshafts 146. The respective camshafts 146, 148 extend within camshaft chambers 150 that are defined by the cylinder head members 80 and camshaft covers 152. The camshafts 146, 148 are journaled by the cylinder head members 80 and rotatably affixed thereto by camshaft caps 154.

The intake camshafts 146 actuate the intake valves 106, while the exhaust camshafts 148 actuate the exhaust valves 140. The respective camshafts 146, 148 have cam lobes 156 to push the intake and exhaust valves 106, 140 at certain timings to open and close the intake and exhaust ports 100, 138, respectively.

As seen in FIG. 2, the crankshaft 88 drives the exhaust camshafts 148. The exhaust camshafts 148 have driven sprockets 160 fitted thereto, while the crankshaft 88 also has a drive sprocket 162 fitted thereto. A guide or idle roller 163 is also provided. A timing chain 164 is wound around the drive and driven sprockets 162, 160 and the guide roller 163. When the crankshaft 88 rotates, the exhaust camshafts 148 also rotate.

As seen in FIG. 3, the exhaust camshafts 148 drive the intake camshafts 146. The exhaust camshafts 148 have drive sprockets 165, while the intake camshafts 146 have driven sprockets 166. Timing chains 168 are wound around the respective drive and driven sprockets 165, 166. Chain guide members 170 are provided for guiding the chains 168. With rotation of the exhaust camshafts 148, the intake camshafts 146 rotate also.

The driven sprockets 160 of the exhaust camshafts 148 have diameters twice as large as the diameter of the drive sprocket 162 of the crankshaft 88 such that the exhaust camshafts 148 rotate at half of the speed of crankshaft 88. The drive sprockets 165 of the exhaust camshafts 148 and the driven sprockets 166 of the intake camshafts 146 have the same diameter so that the camshafts 146, 148 rotate at the same speed.

Figure 12:
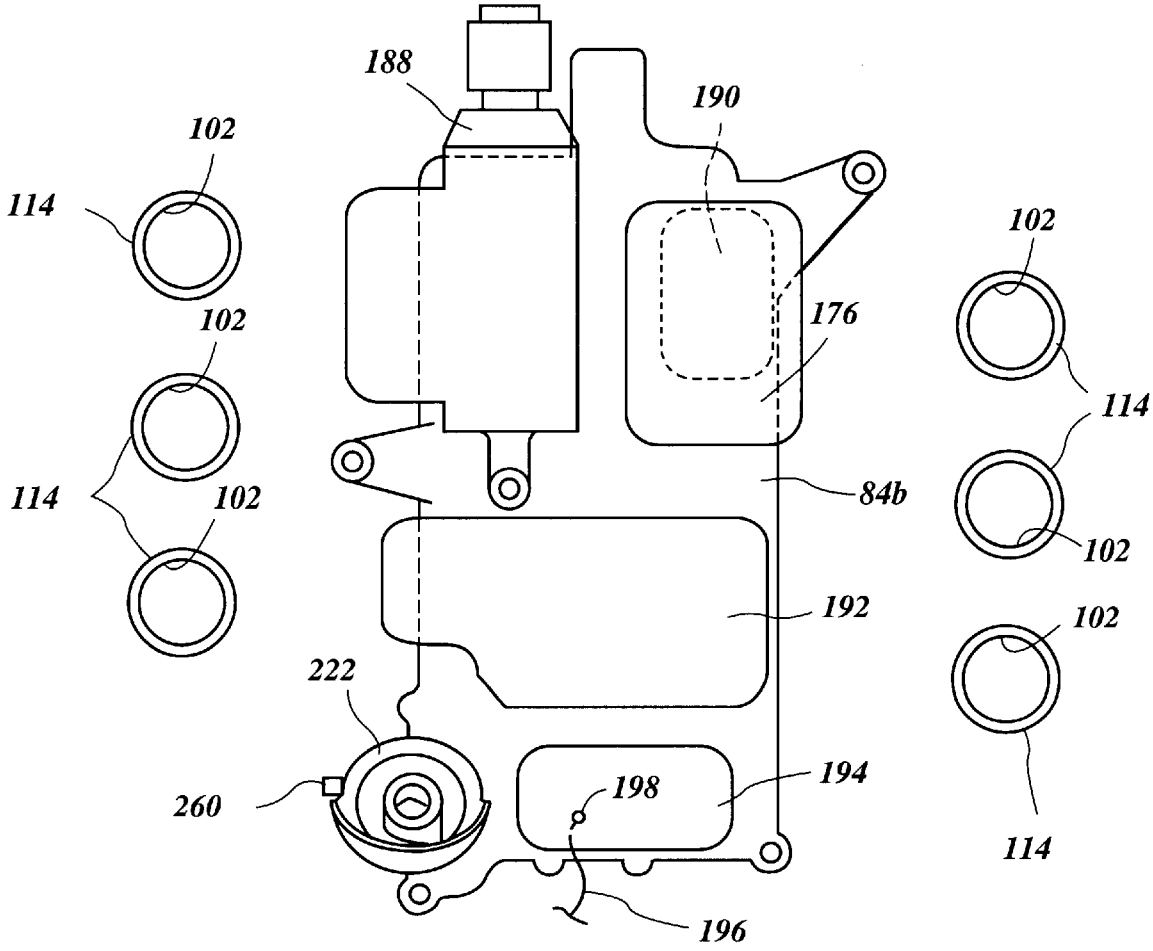
FIG. 12 is a schematic front view showing arrangements of the crankcase cover, the intake passages and the electrical components.

In the illustrated embodiment, the engine 32 has a port or manifold fuel injection system, although other conventional fuel supply and charge forming systems such as a direction injection fuel system or carburetors can be applied. The fuel injection system of the illustrated embodiment includes six fuel injectors 174, each injector associated with a respective one of the combustion chambers 82. The fuel injectors 174 have injection nozzles directed toward the respective intake passages 102 adjacent to the intake ports 100. The fuel injectors 174 spray fuel into the intake passages 102 under a control of an ECU (Electronic Control Unit) 176 (FIG. 12). More specifically, the ECU 176 controls the fuel amount delivered by and the timing of each injection. Fuel rails, which are affixed to the throttle bodies 112, support the fuel injectors 174.

The fuel injection system further includes a fuel supply tank that is placed in the hull of the associated watercraft 42 to contain fuel that will be sprayed by the fuel injectors 174. Fuel is drawn from the fuel tank through a fuel supply passage by a low-pressure fuel pump and supplied to a fuel reservoir or fuel vapor separator 178.

As seen in FIGS. 2 and 3, the vapor separator 178 is generally disposed in a space 182 defined between the port side surface of the crankcase assembly 84 and the intake runners 114. At the end of the supply passage to the vapor separator 178, a float valve is provided that is operated by a float so as to maintain a generally uniform level of the fuel in the vapor separator 178. A high-pressure fuel pump is placed in the vapor separator 178 and pressurizes the fuel that is delivered to the fuel injectors 174 through a fuel delivery passage that includes the fuel rail. The high-pressure fuel pump preferably is an electric pump that is driven by an electric motor and develops a pressure greater than the pressure developed by the low-pressure fuel pump 174.

A fuel return passage connects a portion of the fuel delivery passage to the vapor separator 178 to return excess fuel thereto. A pressure regulator is positioned in the return passage and limits the pressure that is delivered to the fuel injectors 174 to a preset and fixed magnitude by dumping the fuel back to the vapor separator 178 when the pressure in the fuel rail is greater than the preset magnitude. Because the pressure regulator keeps the pressure at this constant magnitude, the ECU 176 controls the duration of each injection so as to control the amount of the fuel injected.

The engine 32 further includes an ignition or firing system. In the illustrated embodiment, three spark plugs 180 are mounted on each cylinder head member 80 so as to each expose their electrodes to the associated combustion chambers 82. The spark plugs 180 fire air/fuel charges in the combustion chambers 82 at each proper timing. The ECU 176 also controls this firing timing. The air/fuel charge is formed with the air supplied by the air induction system 98 and the fuel sprayed by the fuel injectors 174 of the fuel injection system.

A flywheel assembly 184 is affixed atop the crankshaft 88. The flywheel assembly 184 includes a generator to supply electric power to the firing system, to the ECU 176 and to other electrical components via a battery 186 and/or directly.

As seen in FIG. 1, the battery 186 is disposed in the hull of the watercraft 42. The electrical components include a starter motor 188, a rectifier regulator 190, a relay box 192 containing various relay elements and a fuse box 194 containing fuses.

As seen in FIGS. 3, 9 and 12, these electrical components 188, 190, 192, 194 are disposed in a space defined between the crankcase assembly 84 and the plenum chamber members 116 and are affixed to the crankcase cover 84*b*. In the illustrated embodiment, the ECU 176, the starter motor 188 and the rectifier regulator 190 are positioned at an upper portion of the crankcase cover 84*b*. The ECU 176 and the rectifier regulator 190 are placed in parallel to the starter motor 188, and the regulator 190 is disposed below the ECU 176. The relay box 192 is positioned at a middle portion and the fuse box 194 is positioned under the relay box 192.

This arrangement is advantageous because not only can the space between the crankcase assembly 84 and the plenum chamber members 116 be effectively used, but also because the electrical components 188, 190, 192, 194 can be well protected by the plenum chamber members 116 particularly when the top cowling member 62 is detached.

The arrangement described above, however, merely exemplifies one suitable construction and any other arrangements are practicable. Also, other engine-related components can be placed in this space.

In the illustrated embodiment, as seen in FIGS. 1 and 12, the battery 186 is grounded to the engine body at the crankcase cover 84*b*. That is, a ground line 196 of the battery 186 is connected to a portion 198 of the crankcase cover 84*b*. Because of this, the electrical components 176, 188, 190, 192, 194 can be easily grounded by connecting their ground lines to the crankcase cover 84*b*.

The engine 32 also includes a lubrication system. A lubricant reservoir or oil pan 200 depends from the exhaust guide member 68 into the driveshaft housing 56 and contains lubricant oil (this term is used generically herein to include both natural, synthetic and hybrid lubricants). The lubricant reservoir 200 in this embodiment is generally configured as a doughnut shape. A suction pipe 202 is provided in the lubricant reservoir 200 to connect the reservoir 200 to an oil pump unit 204. The suction pipe 202 has a port at almost the bottom position of the lubricant reservoir 200. An oil strainer 206 is provided at the port for removing foreign substances from the lubricant oil.

The crankshaft 88 drives the oil pump unit 204 for the lubrication system. The lubricant in the lubricant reservoir 200 is drawn by this oil pump unit 204 and is delivered to engine portions that need lubrication. The oil pump unit 204 is disposed at the bottom of the engine 32. As best seen in FIG. 5, the oil pump unit 204 has an inlet port 210 and an outlet port 212. The inlet port 210 communicates with the suction pipe 202 through a suction passage 214, while the outlet port 212 communicates with the engine portions through a delivery passage 216. The suction passage 214 is defined in the exhaust guide member 68 and the cylinder body 74, while the delivery passage 216 is defined in the cylinder body 74. A construction of the oil pump unit 204 will be described in detail shortly.

Figure 6:
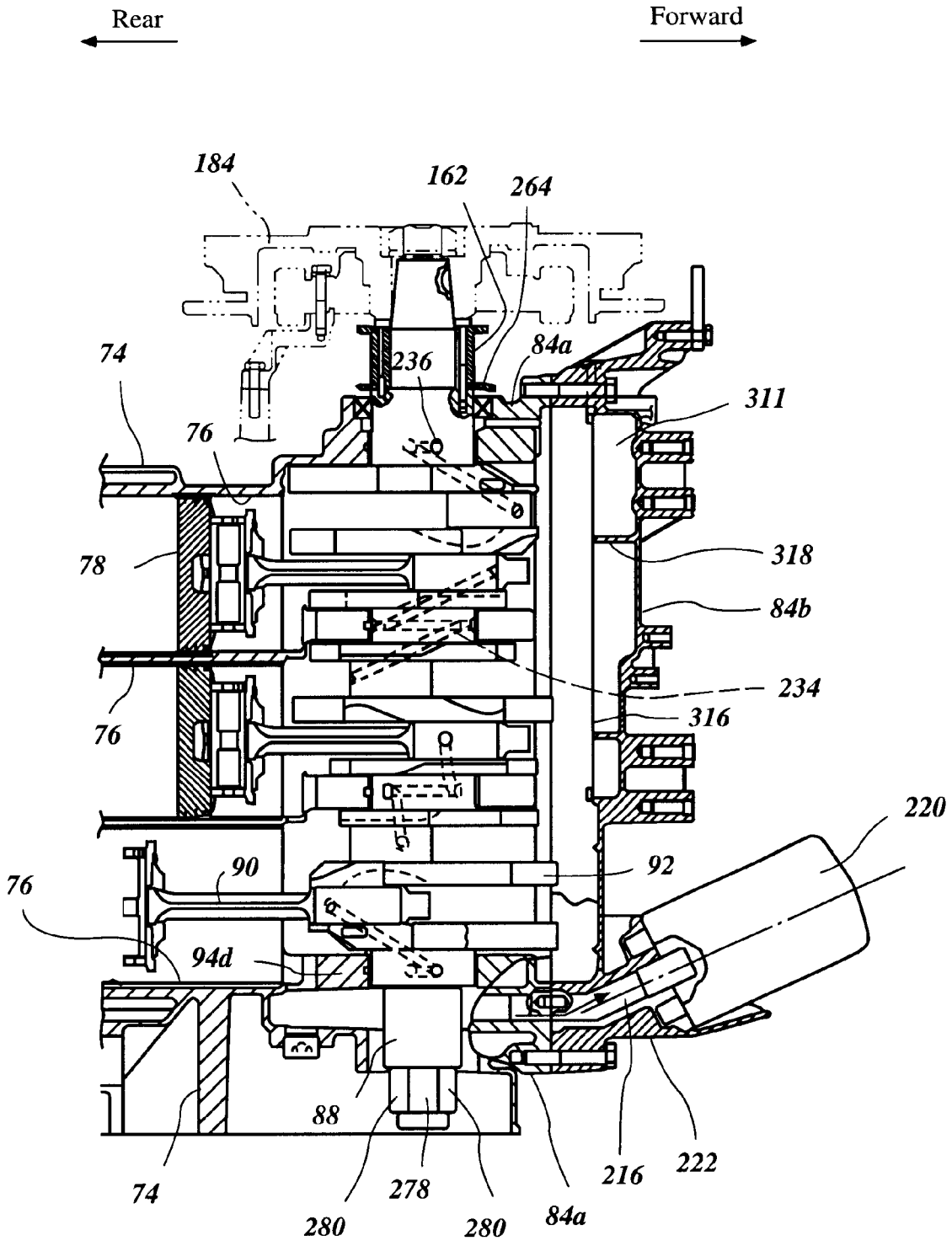
FIG. 6 is a sectional side view of a portion of the engine generally taken along a vertical plane including a centerline extending through a cylinder body, a crankcase member and a crankcase cover. The oil pump unit and a baffle plate are omitted.

The engine portions that need lubrication include, for example, crankshaft bearing portions 218 where the bearing blocks 94*a*, 94*b*, 94*c*, 94*d* support the crankshaft 88. As best seen in FIGS. 6 and 11, an oil filter 220 is detachably affixed to a mounting boss 222 formed at a bottom portion of the crankcase cover 84*b* to remove further foreign substances from the lubricant. The delivery passage 216 communicates with the oil filter 220. The oil filter 220 communicates with a supply passage 224 (FIG. 5) and then with a main gallery 226 (FIGS. 3, 4 and 11), both defined in the cylinder body 74. A closure member 230 closes the top portion of the main gallery 226. The lubricant is then supplied to the respective bearing portions through branch passages defined within the bearing blocks 94*a*, 94*b*, 94*c*, 94*d*. After the lubrication has been delivered to the bear blocks, the lubricant drops to the bottom of the crankcase chamber 86 due to gravity.

The engine portions that need lubrication further include portions where the connecting rods 90 are coupled with the crankshaft 88 and where they are coupled with the pistons 78. The pistons 78 furiously reciprocate within the cylinder bores 76 and thus the pistons 78 also need the lubrication. Some of the lubricant is delivered to those portions through drilled passages 234 in the crankshaft 88 and in the connecting rods 90. Inlet ports 236 are opened at certain portions of the crankshaft 88. The lubricant, after lubricating these portions, also falls to the bottom of the crankcase chamber 86.

The pistons 78 need lubrication so as not to seize on surfaces of the cylinder bores 76. One or more through-holes are made at each skirt portion of the piston 78 and hence the lubricant oil can move out to the outer surface of the piston 78 which slides along the surface of the cylinder bore 76. Piston rings are provided on and around the pistons 78 primarily to isolate the combustion chambers 82 from the crankcase chamber 86. At least one piston ring, which is normally placed at the lowermost position, can remove the lubricant from the surface of the cylinder bore 76 to the crankcase chamber 86.

The engine portions that need lubrication further include the camshaft bearing portions. Lubricant delivery arrangements for the camshaft bearing portions are similar to the arrangement described above.

The lubricant that has dropped to the bottom of crankcase chamber 86 returns to the lubricant reservoir 200 through a return passage. The lubricant oil that has returned to the lubricant reservoir 200 is recycled so as to lubricate the same engine portions repeatedly.

As best seen in FIG. 11, the lubrication system has a lubricant supplement pipe 240 affixed to a side surface of the crankcase cover 84*b*. A cap 242 closes an inlet port atop the pipe 240.

Figure 13:
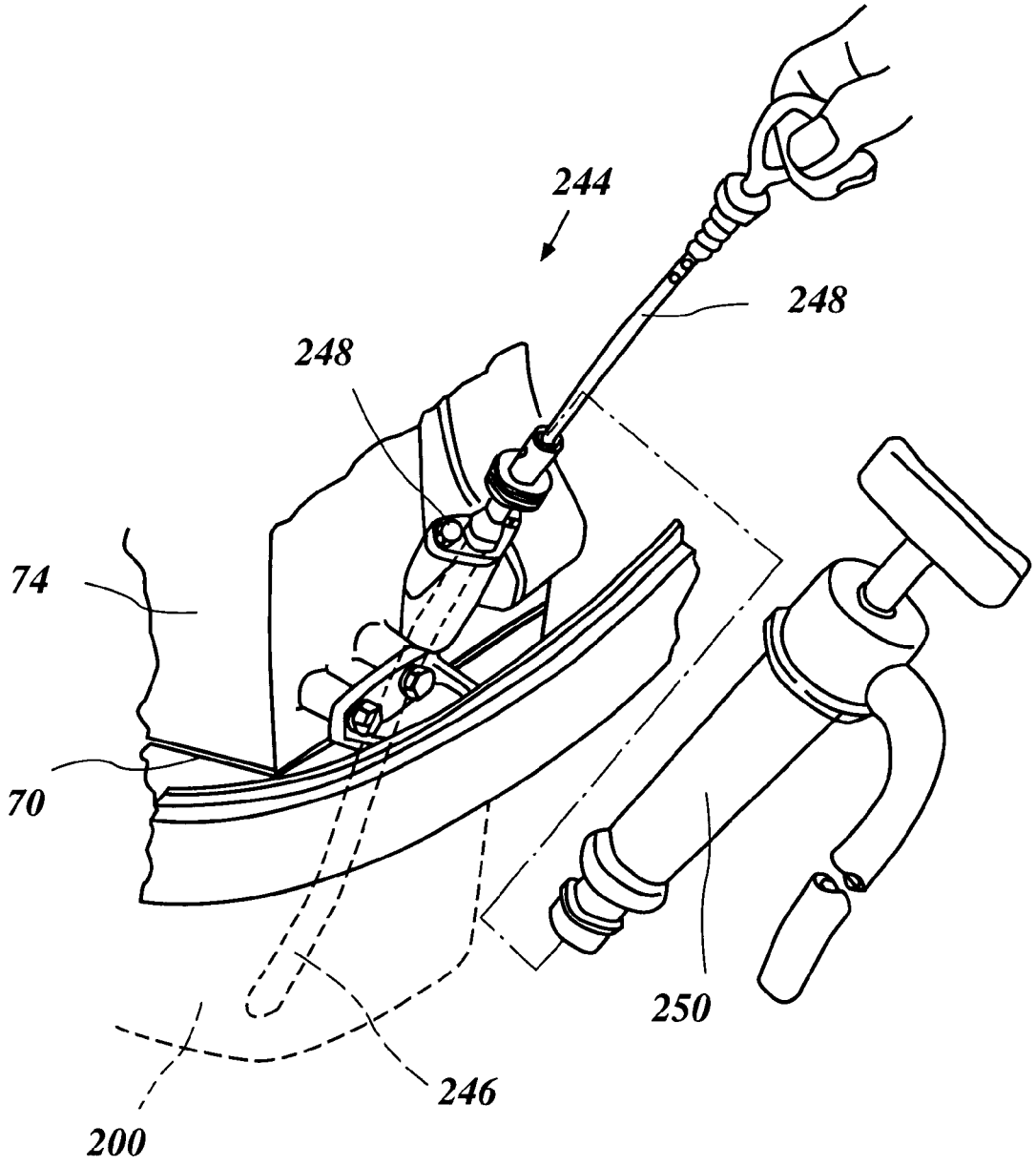
FIG. 13 is a perspective side view showing a portion of the cylinder body where an oil dipstick is positioned.

The lubrication system further has a level gauge unit 244 including a guide pipe 246, which are a rigid pipe, and a dipstick 248. As best seen in FIG. 13, the guide pipe 246 passes through an opening formed at a bottom portion of the cylinder body 74 and its top portion is detachably affixed to the portion of the cylinder body 74 by a bolt 248. The lowermost portion of the guide pipe 246 reaches a proximity to the bottom of the lubricant reservoir 200. The dipstick 248 is normally inserted into the guide pipe 246. The operator or user of the outboard motor 30 can take the dipstick 248 out of the guide pipe 246 to check an amount of the lubricant and/or a condition of the lubricant (i.e., whether it is dirty or clean). If the operator replaces the dipstick 248 with an oil remover pump 250, the lubricant in the reservoir 200 can be removed therefrom.

The engine 32 further has a water-cooling system that provides cooling water to engine portions, for example, the cylinder body 74 and the cylinder head member 80 because they get quite hot during engine operations. For instance, water jackets 256 (FIG. 4) are formed within the cylinder body 74, the cylinder head member 80 and the crankcase assembly 84. The water is also supplied to the exhaust system 136. Cover members 258, as best seen in FIG. 3, are affixed to the exhaust members 142 also to define the water jackets 256 therebetween. The cooling water is introduced from the body of water surrounding the outboard motor 30 in a manner that is well known.

Additionally, the engine 32 in the illustrated embodiment has a number of engine-related devices or components that are mounted onto the engine 32 or provided adjacently to the engine 32 other than, for example, the ECU 176 and the starter motor 188. In the illustrated embodiment, for example, an oil pressure sensor 260 (FIG. 12) is further provided on the crankcase cover 84*b* for sensing an oil pressure of the lubrication system. A crankshaft angle position sensor 262 (FIG. 5) is also provided atop the cylinder body 74 in the close proximity to a washer 264 affixed to the crankshaft 88. The washer 264 has notches around its outer periphery. The position sensor 262 is a proximity switch that generates signals when the notches approach thereto. The sensed signals by the oil pressure sensor 260 and the position sensor 262 are sent to the ECU 176 and are used, for example, for various engine controls.

With reference back to FIG. 1, the driveshaft housing 56 depends from the power head 54 and supports a driveshaft 270, which is driven by the crankshaft 88. The crankshaft 88 has a splined recess 271 at its bottom portion, while the driveshaft 270 has a splined top. The splined top of the driveshaft 270 is fitted into the splined recess 271 of the crankshaft 88 so that the driveshaft 270 is coupled with the crankshaft 88. The driveshaft 270 extends generally vertically through the exhaust guide member 68 and then extends through the driveshaft housing 56 in front of the lubricant reservoir 200.

The driveshaft housing 56 also defines internal passages that form portions of the exhaust system 136. In the illustrated embodiment, an exhaust pipe 272 depends from the exhaust guide member 68 and extends downwardly through a center hollow of the lubricant reservoir 200. An upper portion of the exhaust pipe 272 communicates with the exhaust passage 72 defined in the exhaust guide member 68. An exhaust expansion chamber depends from a bottom of the lubricant reservoir 200. A lower portion of the exhaust pipe 272 communicates with the expansion chamber. The expansion chamber has a relatively large capacity so that the exhaust gases expand there to lose energy and silence exhaust noise. An idle exhaust passage branches from one of the internal passages and opens to the atmosphere above the body of water.

With reference to FIGS. 1, 5 and 6, the construction of the oil pump unit 204 will now be described. The oil pump unit 204 is defined at the bottom portion of the cylinder body 74 and the crankcase member 84a where the driveshaft 270 is coupled with the crankshaft 88. In the illustrated embodiment, the oil pump unit 204 defines a rotary or trochoid pump. This type of pump, however, is merely exemplary of a type that can be used with the lubrication system. Other types of pumps such as, for example, a gear pump, are applicable.

An upper housing member 272 is affixed to the bottom of the cylinder body 74 and the crankcase member 84*a* by bolts 273. The upper housing member 272 has a cylindrical portion 274 fitted into a recessed portion defined by the cylinder body 74 and the crankcase member 84*a*. The cylindrical portion 274 defines an opening through which the crankshaft 88 extends. An upper oil seal member 276 is provided between an outer surface of the crankshaft 88 and an inner surface of the upper housing member 272 for preventing the lubricant in the oil pump unit 204 from leaking out. The foregoing inlet port 210 and the outlet port 212 are formed at the upper housing member 272. The upper housing member 272 preferably is made of metal or plastic.

As seen in FIG. 6, the crankshaft 88 is cut away to define two flat surfaces 278 extend in parallel to each other. The other surfaces 280 of the crankshaft between the flats 278 hold arc configurations. An inner rotor 282, which has a recess that is conversely configured relative to the outer configuration of the crankshaft 88, is fitted onto the crankshaft 88 via a drive collar or bush member 284. An outer rotor 286 then meshes with the inner rotor 282. The inner and outer rotors 282, 286 together form a pumping assembly.

It should be noted that the drive collar 286 is dispensable. In this variation, the inner rotor 286 is directly coupled with the crankshaft 88.

A lower housing member 288 is affixed to the lower surface of the upper housing member 272 so as to define a pump cavity with the upper housing member 272 in which the inner and outer rotors 282, 286 are disposed. In the illustrated embodiment, the lower housing member 288 is defined by a single piece. The lower housing member 288 has an opening through which both the crankshaft 88 and the driveshaft 270 extend. The bolts 273 are used in this embodiment to fix the lower housing member 288 to the upper housing member 272. An inlet passage 290 and an outlet passage 292 are defined between the upper housing member 272 and the lower housing member 288. The inlet passage 290 communicates with the inlet port 210, while the outlet passage 292 communicates with the outlet port 212. The lower housing member 288 preferably is made of metal or plastic.

A lower oil seal member 294 is provided between another outer surface of the crankshaft 88 and an inner surface of the lower housing member 288. A water seal member 296 is further provided between a surface of the driveshaft 270 and another inner surface of the lower housing member 288. The lower oil seal member 294 inhibits the lubricant oil in the oil pump unit 204 from leaking out from the oil pump unit 214, while the water seal member 296 inhibits water or water mist around the coupling portion from contacting the coupling portion.

In the illustrated embodiment, the crankshaft 88 actually defines three sections having different diameters. An upper section is larger than a middle section, and the middle section is larger than a lower section. The upper oil seal member 276 is positioned at the upper section. The inner and outer rotors 282, 286 are positioned at the middle section. The lower oil seal member 296 is positioned at the lower section.

With rotation of the crankshaft 88, the crankshaft 88 drives the inner rotor 282 via the drive collar 284. Because the outer rotor 286 meshes with the inner rotor 282, the outer rotor 286 also rotates with the inner rotor 282. A space, which is defined between the inner and outer rotors 282, 286, communicates with the inlet passage 290 and the outlet passage 292, and changes its volume with the rotation of the inner and outer rotors 282, 286. The oil in the space is thus drawn into the space from the inlet passage 290 and then pushed out to the outlet passage 292.

Because the lower oil seal member 294 inhibits the oil in the housing members 272, 288 from leaking, the oil cannot accumulate at the coupling portion of the driveshaft 270 with the crankshaft 88 and hence will not deteriorate.

In addition, the lower oil seal member 296 faces the outer surface of the crankshaft 88 without having something such as a sleeve lie therebetween. This outer surface of the crankshaft 88 therefore can be simultaneously machined with other portions that need to be machined. The construction thus does not require an additional manufacturing step, unlike conventional constructions.

With reference to FIG. 1 again, the lower unit 58 depends from the driveshaft housing 56 and supports a propulsion shaft 300 that is driven by the driveshaft 270. The propulsion shaft 300 extends generally horizontally through the lower unit 58. In the illustrated embodiment, the propulsion device supports a propeller 302 that is affixed to an outer end of the propulsion shaft and is driven thereby. The propulsion device, however, can take the form of a dual, a counter-rotating propeller system, a hydrodynamic jet, or like propulsion devices.

A transmission 304 is provided between the driveshaft 270 and the propulsion shaft 300. The transmission 304 couples together the two shafts 270, 300 that lie generally normal to each other (i.e., at a 90° shaft angle) with a bevel gear train or the like. The transmission 304 has a switchover or clutch mechanism to shift rotational directions of the propeller 302 between forward, neutral or reverse. The switchover mechanism is operated by the operator through a shift linkage including a shift cam, a shift rod and a shift cable 306 (FIG. 9). The shift cable 306 extends toward the watercraft 42 along with the throttle cable 128.

The lower unit 58 also defines an internal passage that forms a discharge section of the exhaust system 136. An upper portion of this internal passage connects to the expansion chamber in the driveshaft housing 56. At engine speeds above idle, the majority of the exhaust gases are discharged toward the body of water through the internal passage and a hub of the propeller 302. At idle, the exhaust gases are mainly discharged through the idle exhaust passage because the exhaust pressure under this condition is less than the backpressure created by the body of water.

With reference to FIGS. 3, 4, 10 and 11, the crankcase assembly 84 and the crankcase chamber 86 will now be described in greater detail below. In the illustrated embodiment, a baffle plate 310 is affixed to the crankcase member 84*a* to divide the crankcase chamber 86*a* into a primary chamber 86*a* and a secondary chamber 86*b*, although both the chambers 86*a*, 86*b* communicate with each other through a plurality of slits or through-holes 312 (FIG. 11) and spaces defined at both sides of the baffle plate 310. The primary chamber 86*a* has a larger capacity than the secondary chamber 86*b* and the crankshaft 88 exists in the primary chamber 86*a*. Also, the baffle plate 310 bulges out toward the secondary chamber 86*b*.

Part of the lubricant oil, after lubricating the respective engine portions, hangs in the air of the primary chamber 86*a* as mist or vapor. This lubricant mist is tends not to drop down to the lubricant reservoir 200 because the rotation of the crankshaft 88 swirls the mist fuiriously. The lubricant, however, preferably returns to the lubricant reservoir 200 as soon as possible to be reused.

The baffle plate 310 is advantageous for returning the lubricant quickly to the reservoir 200. The lubricant mist moves into the secondary chamber 86*b* through the slits 312 in the plate 310 and spaces defined at both sides thereof. Once it has moved to the secondary chamber 86*b*, the mist soon condenses to a liquid state lubricant by adhering to surfaces of the baffle plate 310 and an inner surface of the crankcase cover 84*b*. The rotational movement of the crankshaft 88 does not significantly influence the mist in this secondary chamber 86*b*. The liquid lubricant thus drops to the bottom of the lubricant reservoir 200 along the surfaces of the baffle plate 310 and the crankcase cover 84*b*.

The lubricant mist in the primary chamber 86*a* also includes blow-by gases. The blow-by gases comprise unburnt charges and a small amount of exhaust gases that have passed from the combustion chambers 82. Although the combustion chambers 82 are isolated by the piston rings as noted above, those gases can leak to the crankcase chamber 86 because of large expansion pressure generated in the combustion chambers 82.

In order to remove the blow-by gases and oil vapors that remain still in the secondary chamber 86*b*, a ventilation system is provided in the engine 32 of this embodiment. The ventilation system comprises a breather chamber or oil separator 311 and a breather pipe 313.

Figure 10:
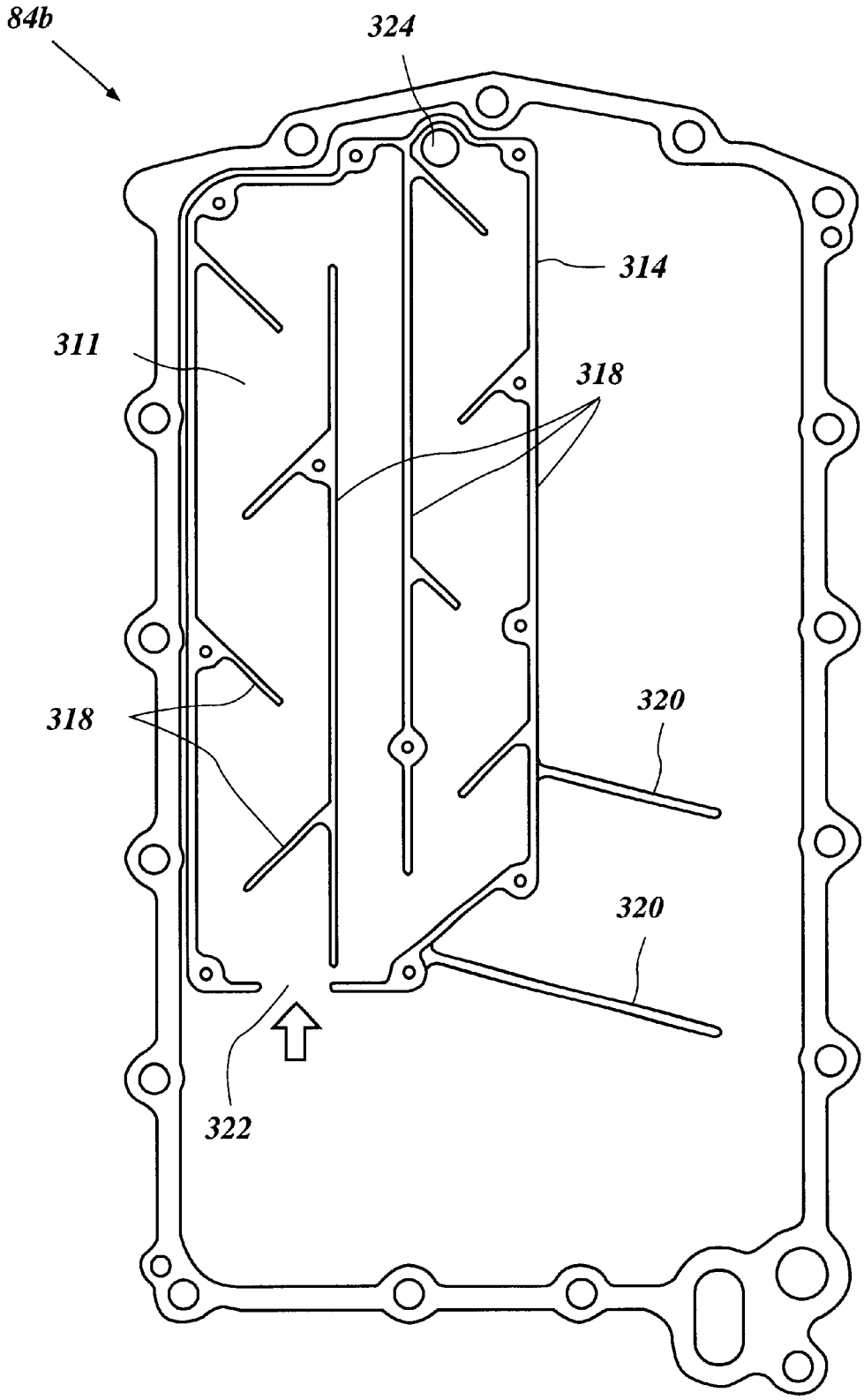
FIG. 10 is a rear view of the crankcase cover.

As best seen in FIGS. 6 and 10, the breather chamber 311 is defined by an inner surface of the crankcase cover 84*b*, a rampart 314 that extends from the inner surface of the crankcase cover 84*b* and a lid plate 316 that is affixed to the rampart 314. A plurality of baffle projections 318 also extends from the inner surface of the crankcase cover 84*b* so that a labyrinth structure is formed within the breather chamber 311. The baffle projections 318 are generally directed downwardly. Additionally, other baffle projections 320 are provided out of the breather chamber 311 in the same manner.

An inlet port 322 of the breather chamber 311 opens downwardly at its bottom portion, while an outlet port 324 thereof, which is a through-hole, opens atop the breather chamber 311 and also atop of the crankcase cover 84*b*.

As best seen in FIG. 4, the breather pipe 313 couples the breather chamber 311 with one or both of the plenum chambers 104. In the illustrated embodiment, the plenum chamber member 116, which is disposed on the port side, has an inlet port 326, and the breather pipe 313 connects the outlet port 324 of the breather chamber 311 to the inlet port 326 of this plenum chamber member 116.

The oil vapors or mist, including the blow-by gases, are introduced into the breather chamber 311 through the inlet port 322 because as the air in the plenum chamber 104 is drawn to the combustion chambers 82 during engine operations the breather chamber 311 is depressurized. The baffle projections 320 formed in the breather chamber 311 inhibit the oil vapors from passing to other portions in the crankcase cover. The oil vapors introduced into the breather chamber 311 are directed to the outlet port 324 through the labyrinth structure. Because the baffle projections 318 prevent the oil vapors from flowing directly and smoothly, the lubricant component of the vapors condense and thus are separated from gases. The liquid oil then drops down to the lubricant reservoir 200 and only the gases pass through the outlet port 324. The gases then move to the plenum chamber 104 through the breather pipe 313 and further to the combustion chambers 82 through the intake passages 102. Once the gases reach the combustion chambers 82, they are burned therein with the air/fuel charges that have been simultaneously supplied to the combustion chambers 82.

Because the breather 311 is positioned in the close proximity to the plenum chamber 104 in this embodiment, the length of the breather pipe 313 can be short so as to simplify the engine layout.

With reference to FIGS. 1 to 4, 7 and 9, the air induction system 98, particularly the plenum chamber members 116, will now be described in greater detail below. As best seen in FIGS. 2 to 4, in the illustrated embodiment, both the plenum chamber members 116 are generally disposed on the front side of the engine. The plenum chamber members 116 are positioned in close vicinity to each other. The engine 32 has a center line C (FIG. 4) extending through both the cylinder body 74 and the crankcase assembly 84. The plenum chamber members 116 are spaced apart from each other so as to exist on both sides of the centerline C. As best seen in FIG. 4, the crankcase assembly 84 in this embodiment has a surface extending generally normal to the centerline C, although the surface has irregularities. Both the plenum chamber members 116 face to the surface. The throttle bodies 112 have axes extending generally in parallel to the centerline C. Although the intake runners 114 curve toward the plenum chamber members 116, at least portions connected to the throttle bodies 112 also extends generally in parallel to the center line C.

The plenum chamber members 116 have air inlet ports 330 opening toward the crankcase assembly 84 and each axis of the inlet port 330 extends generally in parallel to the centerline. That is, the air inlet ports 330 face to the electrical components 176, 188, 190 192, 194 placed between the crankcase assembly 84 and the plenum chamber members 116. The air in the closed cavity 61 of the cowling assembly 60 is introduced into the plenum chambers 104 through the inlet ports 330 without interfering with each other. Before entering, the air flows around the electrical components 176, 188, 190 192, 194. The electrical components 176, 188, 190 192, 194 may be warm during their operations. The airflow over these components cools them.

As best seen in FIGS. 4 and 7, a balance pipe or balance conduit 332 couples both the plenum chambers 104 together. The conduit 332 is a relatively small pipe (in comparison to the cross-sectional size of the plenum chambers) to balance or equalize the air intake pressure within the respective plenum chambers 104. The conduit 332 is generally configured as a U-shape and has a passage portion 334 and a pair of connecting portions 336. Each plenum chamber member 116 has a recess 340 at its forward portion. The recesses 340 of the respective plenum chamber members 116 are generally sequentially formed with the other one that is defined at the other plenum chamber member 116. A hollow coupling projection 342 extends from each of the plenum chamber member 116 at the recess 340. The connecting portions 336 are fitted into the respective coupling projections 342 to complete the communication of the plenum chambers 104 with each other. When the connecting portions 336 are coupled with the projections 342, outer forward surfaces of the plenum chamber members 116 and an outer surface of the conduit 332 together define an even surface. That is, the conduit 332 is generally completely fitted in the recesses 340 and does not project from the forward surface of the plenum chamber members.

Figure 8:
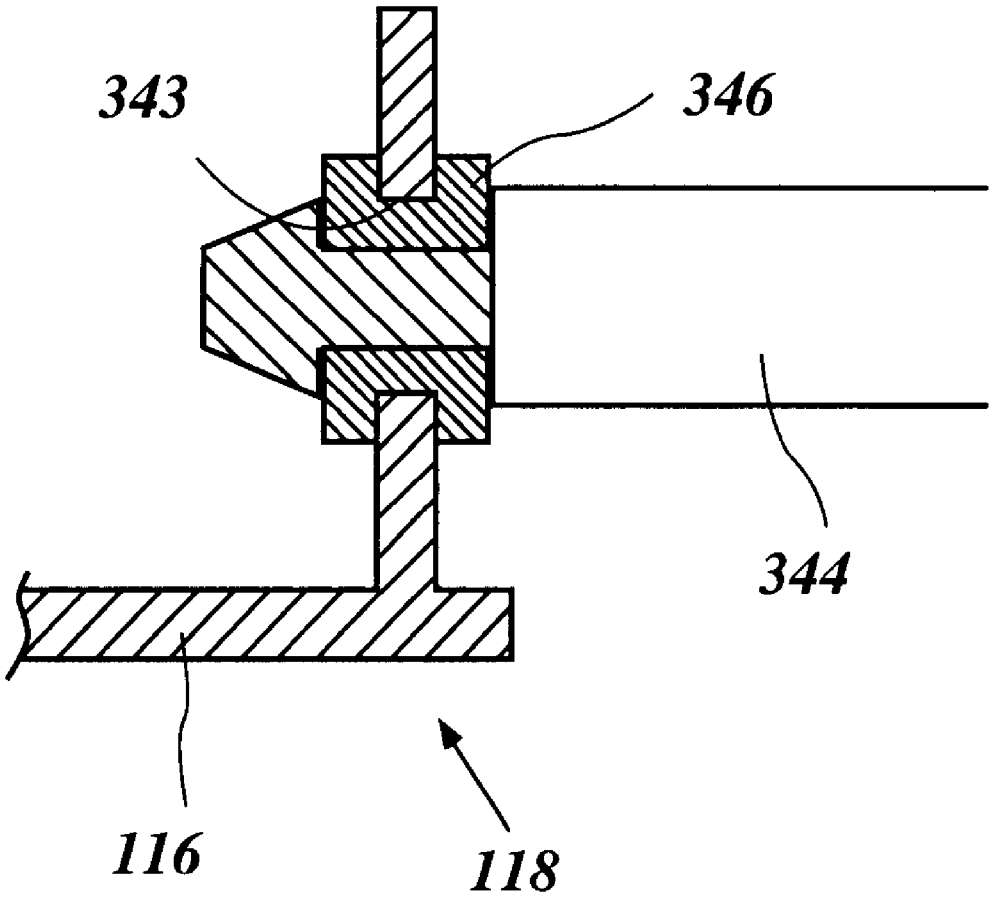
FIG. 8 is a sectional view of a one-touch fastener including a rod member and a grommet.

With primary reference primarily to FIGS. 4, 7 and 8, a mount construction of the intake units 118 will now be described below. The plenum chamber member 116 of the intake units 118, which is disposed on the port side, has a pair of projections 341*a* that extend transversely toward the opposite side of the other intake unit 118 on the starboard side and spaced apart vertically from each other. The projections 341*a* define through-holes 343. The plenum chamber member 116 on the starboard side, in turn, has also a pair of projections 341*b* extending transversely toward the other intake unit 118 on the port side and spaced apart vertically from each other. Four rod members 344, each of which has a hexagonal shape in section, are screwed down to the crankcase cover 84*b* at appropriate locations so that the intake units 118 can be placed as described above. Each axis of the rod member 344 when screwed down to the crankcase cover 84*b* extends generally in parallel to the centerline C. As best seen in FIG. 8, each tip portion of the rod member 344 is cut circularly and a rubber grommet 346 is fitted into the circular recess. The grommets 346 of the respective rod members 344 are then fitted into the through-holes 343. The rod members 344 and the grommets 346 define one-touch fasteners.

The rear end portions 348 of the intake runners 114 of the intake units 118 are connected to the front end portions 350 of the throttle bodies 112 via rubber sealing members 352, which is shaped as a ring. As seen in FIG. 4, the sealing member 352 is detachably fitted onto the front end portions 350 of the throttle bodies 112 and then the rear end portions 348 of the intake runners 114 are detachably fitted into the sealing members 352 so as to complete air tight connections between the respective throttle bodies 112 and the intake runners 114.

When assembling the intake units 118 with the engine 32, the respective intake runners 114 are connected to the respective throttle bodies 112 via the sealing members 352. The rod members 344, which have been already screwed down to the crankcase cover 84*b*, are then fitted into the grommets 346, which have been also put at the projections 341*b* of the plenum chamber members 116. The breather pipe 313 is also fixed to the outlet port 324 of the breather 311 and the inlet port of the plenum chamber 104. Finally, the connecting portions 336 of the balance pipe 332 are affixed to the respective coupling projections 342 of the plenum chamber members 116 so that the passage portion 334 of the conduit 332 is fitted into the recesses 340.

As described above, in the illustrated embodiment, the plenum chambers are disposed on the front end of the engine. In addition, the plenum chamber members are positioned in close vicinity to each other. The air induction system can thus have intake passages with lengths as long as possible. The arrangement is advantageous for low speed running conditions.

The engine in this embodiment has a pair of plenum chambers rather than a single plenum chamber. The respective plenum chambers are required to be coupled with only the intake passages on one side of the engine because the balance pipe can couples the plenum chambers together. The arrangement thus is easily assembled even though the related components have relatively rough accuracy in their configurations and mount positions on the engine.

While in the illustrated embodiment each plenum chamber member is unified with the corresponding intake runners, it is understood that the plenum chamber members and the respective intake runners can be separate components that are fitted together. In addition, each set of intake runners can be unitary or be separate components.

Because the crankcase cover in the embodiment has not only the breather defined therein and also the electrical components affixed thereto, the crankcase assembly preferably is reinforced to inhibit deformation due to these loadings.

Of course, the foregoing description is that of a preferred embodiment of the present invention, and various changes and modifications may be made without departing from the spirit and scope of the invention, as defined by the appended claims.

What is claimed is:

1. A four-cycle, internal combustion engine comprising a cylinder body defining a plurality of cylinder bores extending generally horizontally and spaced apart horizontally from each other to form a V-configuration, pistons reciprocating within the respective cylinder bores, a pair of cylinder head members closing one ends of the cylinder bores to define combustion chambers with the cylinder bores and the pistons, a crankshaft coupled with the pistons for rotation with the reciprocal movement of the pistons, a crankcase member closing other ends of the cylinder bores to define a crankcase chamber in which the crankshaft extends generally vertically, and an air induction system arranged to introduce air into the combustion chambers, the air induction system including a pair of plenum chamber members generally disposed on an opposite side of the crankcase member relative to the crankshaft, both the plenum chamber members positioned in close vicinity to each other, each one of the plenum chamber members defining a plenum chamber therein and an inlet port to intake the air into the plenum chamber, and a balance pipe affixed to both the plenum chamber members to couple together the plenum chambers.

2. The four-cycle, internal combustion engine as set forth in claim 1, wherein the balance pipe is detachably affixed to both the plenum chamber members.

3. The four-cycle, internal combustion engine as set forth in claim 2, wherein each one of the plenum chamber members has a hollow coupling projection and the balance pipe has ends fitted onto the respective coupling projections.

4. The four-cycle, internal combustion engine as set forth in claim 1, wherein the inlet ports open toward the crankcase member, and the balance pipe is detachably affixed to both the plenum chamber members on an opposite side of the plenum chamber members relative to the inlet ports.

5. The four-cycle, internal combustion engine as set forth in claim 1, wherein the inlet ports open toward the crankcase member.

6. The four-cycle, internal combustion engine as set forth in claim 5, wherein the crankcase member and the respective plenum chamber members define a space therebetween, and at least one engine-related component is placed in the space.

7. The four-cycle, internal combustion engine as set forth in claim 6, wherein the engine-related component includes an electrical component.

8. The four-cycle, internal combustion engine as set forth in claim 7 for use with an outboard motor, wherein the outboard motor includes a cowling member defining an internal cavity in which the engine is enclosed, and the cowling member has an air intake port through which the air is introduced into the internal cavity before being drawn into the combustion chambers through the air induction system.

9. The four-cycle, internal combustion engine as set forth in claim 1 having a center line extending through both the cylinder body and the crankcase member, wherein the plenum chamber members are spaced apart from each other so as to exist on both sides of the center line.

10. The four-cycle, internal combustion engine as set forth in claim 1, wherein the cylinder body includes a plurality of the cylinder bores spaced apart vertically from each other.

11. A four-cycle, internal combustion engine comprising a cylinder body defining a plurality of cylinder bores extending generally horizontally and spaced apart horizontally from each other to form a V-configuration, pistons reciprocating within the respective cylinder bores, a pair of cylinder head members closing one ends of the cylinder bores to define combustion chambers with the cylinder bores and the pistons, a crankshaft coupled with the pistons for rotation with the reciprocal movement of the pistons, a crankcase member closing other ends of the cylinder bores to define a crankcase chamber in which the crankshaft extends generally vertically, and an air induction system arranged to introduce air into the combustion chambers, the air induction system including a pair of plenum chamber members generally disposed on an opposite side of the crankcase member relative to the crankshaft, both the plenum chamber members positioned in close vicinity to each other, each one of the plenum chamber members defining a plenum chamber to intake the air into the air induction system, and a balance pipe detachably affixed to both the plenum chamber members to couple together the plenum chambers, each one of the plenum chamber members having a recess, and the balance pipe being fitted into the recesses so that outer surfaces of the plenum chamber members and the balance pipe generally define together an even surface.

12. A four-cycle, internal combustion engine comprising a cylinder body defining a plurality of cylinder bores extending generally horizontally and spaced apart horizontally from each other to form a V-configuration, pistons reciprocating within the respective cylinder bores, a pair of cylinder head members closing one ends of the cylinder bores to define combustion chambers with the cylinder bores and the pistons, a crankshaft coupled with the pistons for rotation with the reciprocal movement of the pistons, a crankcase member closing other ends of the cylinder bores to define a crankcase chamber in which the crankshaft extends generally vertically, and an air induction system arranged to introduce air into the combustion chambers, the air induction system including a pair of plenum chamber members generally disposed on an opposite side of the crankcase member relative to the crankshaft, both the plenum chamber members positioned in close vicinity to each other, each one of the plenum chamber members defining a plenum chamber to intake the air into the air induction system, each one of the plenum chamber members being affixed to the crankcase member, and a balance pipe affixed to both the plenum chamber members to couple together the plenum chambers.

13. The four-cycle, internal combustion engine as set forth in claim 12, wherein the crankcase member includes an inner member section and an outer member section, and the plenum chamber members are affixed to the outer member section.

14. The four-cycle, internal combustion engine as set forth in claim 12, wherein each one of the plenum chambers is affixed to the crankcase member by a one-touch fastener.

15. The four-cycle, internal combustion engine as set forth in claim 14, wherein the one-touch fastener includes a rod member affixed to the crankcase member and a grommet made of elastic material, each one of the plenum chambers includes a mount portion having a through-hole at which the grommet is affixed, and the rod member is fitted into the grommet.

16. The four-cycle, internal combustion engine as set forth in claim 12 having a center line extending through both the cylinder body and the crankcase member, wherein the one-touch fastener has an axis extending generally parallel to the center line.

17. A four-cycle, internal combustion engine comprising a cylinder body defining a plurality of cylinder bores extending generally horizontally and spaced apart horizontally from each other to form a V-configuration, pistons reciprocating within the respective cylinder bores, a pair of cylinder head members closing one ends of the cylinder bores to define combustion chambers with the cylinder bores and the pistons, a crankshaft coupled with the pistons for rotation with the reciprocal movement of the pistons, a crankcase member closing other ends of the cylinder bores to define a crankcase chamber in which the crankshaft extends generally vertically, the crankshaft being joumalized by bearing blocks, an air induction system arranged to introduce air into the combustion chambers, the air induction system including a pair of plenum chamber members generally disposed on an opposite side of the crankcase member relative to the crankshaft, both the plenum chamber members positioned in close vicinity to each other, each one of the plenum chamber members defining a plenum chamber to intake the air into the air induction system, and a balance pipe affixed to both the plenum chamber members to couple together the plenum chambers, a lubrication system arranged to lubricate at least the bearing blocks by lubricant, a lubricant separator arranged to separate an gaseous component from an liquid component of the lubricant after lubrication, the lubricant separator being defined at the crankcase member, and a breather pipe coupling the crankcase chamber to at least one of the plenum chambers.

18. The four-cycle, internal combustion engine as set forth in claim 17, wherein the lubricant separator includes a labyrinth structure arranged to inhibit the liquid component from passing through the lubricant separator and into the breather pipe.

19. The four-cycle, internal combustion engine as set forth in claim 17 additionally comprising a baffle plate defining a primary space and a secondary space within the crankcase chamber, the crankshaft being disposed in the primary chamber, and the primary space and the secondary space communicating with each other.

20. The four-cycle, internal combustion engine as set forth in claim 19, wherein the baffle plate has at least one through-hole.

21. A four-cycle, internal combustion engine comprising a cylinder body defining a plurality of cylinder bores extending generally horizontally and spaced apart horizontally from each other to form a V-configuration, pistons reciprocating within the respective cylinder bores, a pair of cylinder head members closing one ends of the cylinder bores to define combustion chambers with the cylinder bores and the pistons, a crankshaft coupled with the pistons for rotation with the reciprocal movement of the pistons, a crankcase member closing other ends of the cylinder bores to define a crankcase chamber in which the crankshaft extends generally vertically, and an air induction system arranged to introduce air into the combustion chambers, the air induction system including a pair of plenum chamber members generally disposed on an opposite side of the crankcase member relative to the crankshaft, both the plenum chamber members positioned in close vicinity to each other, each one of the plenum chamber members defining a plenum chamber to intake the air into the air induction system, a balance pipe affixed to both the plenum chamber members to couple together the plenum chambers, a pair of air intake conduits coupling the respective plenum chamber members with the respective combustion chambers, each one of the air intake conduits including a throttle body having a throttle valve, and a runner extending between the throttle body and each one of the plenum chamber members.

22. The four-cycle, internal combustion engine as set forth in claim 21, wherein each one of the plenum chamber members is unified with each one of the runners.

23. The four-cycle, internal combustion engine as set forth in claim 22, wherein each one of the cylinder head members supports each one of the throttle bodies, each one of the plenum chambers is affixed to the crankcase member, and each one of the runners is coupled with each one of the throttle bodies.

24. The four-cycle, internal combustion engine as set forth in claim 22 having a center line extending through both the cylinder body and the crankcase member, wherein coupling portions of the runners with the throttle bodies have axes extending generally in parallel to the center line.

25. The four-cycle, internal combustion engine as set forth in claim 22 having a center line extending through both the cylinder body and the crankcase member, wherein the plenum chamber members are affixed to the crankcase member by a fastener having an axis extending generally in parallel to the center line.

26. A four-cycle, internal combustion engine having a center line extending through both the cylinder body and the crankcase member, and comprising a cylinder body defining a plurality of cylinder bores extending generally horizontally and spaced apart horizontally from each other to form a V-configuration, pistons reciprocating within the respective cylinder bores, a pair of cylinder head members closing one ends of the cylinder bores to define combustion chambers with the cylinder bores and the pistons, a crankshaft coupled with the pistons for rotation with the reciprocal movement of the pistons, a crankcase member closing other ends of the cylinder bores to define a crankcase chamber in which the crankshaft extends generally vertically, and an air induction system arranged to introduce air into the combustion chambers, the air induction system including a pair of plenum chamber members generally disposed on an opposite side of the crankcase member relative to the crankshaft, both the plenum chamber members positioned in close vicinity to each other, each one of the plenum chamber members defining a plenum chamber to intake the air into the air induction system, the plenum chamber members being spaced apart from each other so as to exist on both sides of the center line, and a balance pipe affixed to both the plenum chamber members to couple together the plenum chambers, the crankcase member having a surface extending generally normal to the center line, and both the plenum chamber members facing toward the surface.

27. An internal combustion engine comprising an engine body, a plurality of moveable members moveable relative to the engine body, the engine body and the moveable members defining a plurality of combustion chambers, and an air induction system arranged to introduce air into the combustion chambers, the air induction system including a pair of plenum chamber members, both the plenum chamber members positioned in close vicinity to each other, each one of the plenum chamber members defining a plenum chamber therein and an inlet port to intake the air into the plenum chamber, and a balance pipe affixed to both the plenum chamber members to couple together the plenum chambers, the balance pipe being detachably affixed to both the plenum chamber members, each one of the plenum chamber members having a recess, and the balance pipe being fitted into the recesses so that outer surfaces of the plenum chamber members and the balance pipe generally define together an even surface.

28. An internal combustion engine comprising an engine body, a plurality of moveable members moveable relative to the engine body, the engine body and the moveable members defining a plurality of combustion chambers, and an air induction system arranged to introduce air into the combustion chambers, the air induction system including a pair of plenum chamber members, both the plenum chamber members positioned in close vicinity to each other, each one of the plenum chamber members defining a plenum chamber therein and an inlet port to intake the air into the plenum chamber, and a balance pipe affixed to both the plenum chamber members to couple together the plenum chambers, each one of the plenum chamber members being affixed to the engine body not via another portion of the air induction system.

29. An internal combustion engine comprising an engine body, a plurality of moveable members moveable relative to the engine body, the engine body and the moveable members defining a plurality of combustion chambers, and an air induction system arranged to introduce air into the combustion chambers, the air induction system including a pair of plenum chamber members, both the plenum chamber members positioned in close vicinity to each other, each one of the plenum chamber members defining a plenum chamber therein and an inlet port to intake the air into the plenum chamber, the inlet ports opening toward the engine body, and a balance pipe affixed to both the plenum chamber members to couple together the plenum chambers.

30. An internal combustion engine comprising an engine body, a plurality of moveable members moveable relative to the engine body, the engine body and the moveable members defining a plurality of combustion chambers, and an air induction system arranged to introduce air into the combustion chambers, the air induction system including a pair of plenum chamber members, both the plenum chamber members positioned in close vicinity to each other, each one of the plenum chamber members defining a plenum chamber therein and an inlet port to intake the air into the plenum chamber, a balance pipe affixed to both the plenum chamber members to couple together the plenum chambers, and a pair of air intake conduits coupling the respective plenum chamber members with the respective combustion chambers, each one of the air intake conduits including a throttle body having a throttle valve, and a runner extending between the throttle body and each one of the plenum chamber members.

* * * * *